US007333626B2

(12) United States Patent
Opie et al.

(10) Patent No.: US 7,333,626 B2
(45) **Date of Patent: *Feb. 19, 2008**

(54) ARBITRARY COVERAGE ANGLE SOUND INTEGRATOR

(75) Inventors: Scott M. Opie, Simi Valley, CA (US); Mark E. Engebretson, Encino, CA (US); Yoshiyuki Takeuchi, Pine Mountain Club, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 104 days.

This patent is subject to a terminal disclaimer.

(21) Appl. No.: 11/365,795

(22) Filed: Feb. 28, 2006

(65) Prior Publication Data

US 2006/0177075 A1 Aug. 10, 2006

Related U.S. Application Data

(60) Division of application No. 10/611,012, filed on Jul. 1, 2003, which is a continuation-in-part of application No. 09/921,175, filed on Jul. 31, 2001, now abandoned.

(60) Provisional application No. 60/222,026, filed on Jul. 31, 2000.

(51) Int. Cl.
*H04R 25/00* (2006.01)

(52) U.S. Cl. ..... 381/345; 381/337; 381/347; 181/144; 181/147

(58) Field of Classification Search ..... 381/337–347, 381/350–356, 182; 181/144, 146, 147, 151, 181/154, 199

See application file for complete search history.

(56) References Cited

U.S. PATENT DOCUMENTS

| | | | | |
|---|---|---|---|---|
| 3,931,867 | A | 1/1976 | Janszen | |
| 4,083,426 | A | 4/1978 | Peugh | |
| 4,321,433 | A | 3/1982 | King | |
| 4,845,759 | A | 7/1989 | Danley | |
| 5,590,214 | A | 12/1996 | Nakamura | |
| 6,035,051 | A | 3/2000 | Sato | |
| 6,112,847 | A | 9/2000 | Lehman | |
| 6,282,297 | B1 * | 8/2001 | Lin | 381/182 |
| 6,411,718 | B1 * | 6/2002 | Danley et al. | 381/182 |
| 7,134,523 | B2 * | 11/2006 | Engebretson | 381/337 |
| 2002/0029926 | A1 | 3/2002 | Vincenot et al. | |

OTHER PUBLICATIONS

Fender Audio brochure pages, "1225 Mark III and 1226 Mark III", obtained from the Internet on Oct. 11, 2002 at: <http://www.fenderaudio.com/gear/gear.php?op=3&partno=0711225200>, 2 pages.

(Continued)

*Primary Examiner*—Suhan Ni
(74) *Attorney, Agent, or Firm*—Brinks Hofer Gilson & Lione

(57) ABSTRACT

A system is disclosed for changing a coverage angle of sound produced from a loudspeaker system. The loudspeaker system includes an enclosure that projects sound at a predetermined angle. A sound integrator includes an inner surface positioned adjacent to a mid-range frequency sound source. An outer surface of the sound integrator includes a planar and a curved surface. The surfaces control the angle which sound radiates from the loudspeaker.

8 Claims, 16 Drawing Sheets

OTHER PUBLICATIONS

GEO brochure page, "GEOPages 1", obtained from the Internet on Nov. 14, 2002 at: <http://www.nexo-sa.com/__geo/GEPPPartents1.html>, 1 page.

GEO brochure, "GEOP innovative analysis", dated Jul. 17, 2002, 26 pages.

SHURE brochure pages, "Data Sheet for Model 711 Loudspeaker System Varad™ and SMT Equipped", undated but printed prior to Jul. 1, 2003, 6 pages.

SHURE brochure pages, "711 Professional Loudspeaker System", undated but printed prior to Jul. 1, 2003, 3 pages.

SHURE brochure pages, "Loudspeaker Systems", undated but printed prior to Jul. 1, 2003, 5 pages.

* cited by examiner

ARBITRARY COVERAGE ANGLE SOUND INTEGRATOR

PRIORITY CLAIM

This application is a divisional of U.S. application Ser. No. 10/611,012, filed Jul. 1, 2003, which is a continuation-in-part of U.S. application Ser. No. 09/921,175, filed Jul. 31, 2001 now abandoned, which claims the benefit of U.S. Provisional Patent Application No. 60/222,026 filed Jul. 31, 2000. The disclosures of the above applications are herein incorporated by reference.

BACKGROUND OF THE INVENTION

1. Technical Field

This invention relates generally to loudspeakers, and more particularly to a system for controlling the angular sound coverage of a loudspeaker.

2. Related Art

Enclosures and horns, such as those used with loudspeakers, are designed to control the radiating direction of sound. Sound radiating from sources, in the absence of an enclosure, may spread in uncontrolled directions.

Sound integrators, such as radiation boundary integrators, may be used to integrate sound from mid-range to high frequency sources. The integration may be accomplished by providing a solid boundary that controls the radiation of high frequency sound waves and openings that pass the mid-range frequency sound waves through the solid boundary. The sound integrator may act as a volume displacement device that loads the mid-range frequency sound waves produced by the mid-range frequency loudspeakers.

Although there may be a need to change the angle of coverage of sound radiated from the loudspeaker, the shape of a horn and the loudspeaker enclosure fixes the sound coverage angle of a loudspeaker system. A user of a loudspeaker system may want to direct sound at an angle to reach an audience. Moreover, the user may want to direct the sound away from walls or architectural boundaries that cause wall reflections.

Therefore, a need exists for a sound integrator that changes the radiation coverage angle of a loudspeaker without changing the shape of its enclosure.

SUMMARY

This invention provides a system for controlling a coverage angle of sound projected from a loudspeaker. A sound integrator may be used with the loudspeaker to project sound at a predetermined angle. The sound integrator includes an outer surface that provides a planar and a curved surface. The planar and curved surfaces are used to control the angle that sound radiates from the loudspeaker. The inner surface of the sound integrator may be positioned adjacent to a mid-range frequency sound source to control mid-range sound. Sound integrators may also be interchanged with a loudspeaker, or may be adjusted to vary the angle of a projected sound.

For example, a sound integrator may be constructed that controls radiation in both the horizontal and vertical planes, having sets of horizontally-opposed diverging planar and curved surfaces flanking the high frequency aperture. Also, the perimeter area surrounding the high frequency aperture can be further subdivided to include any number of planar and curved surfaces, such as five, six, eight or more, or a prime number of surfaces so constructed. Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
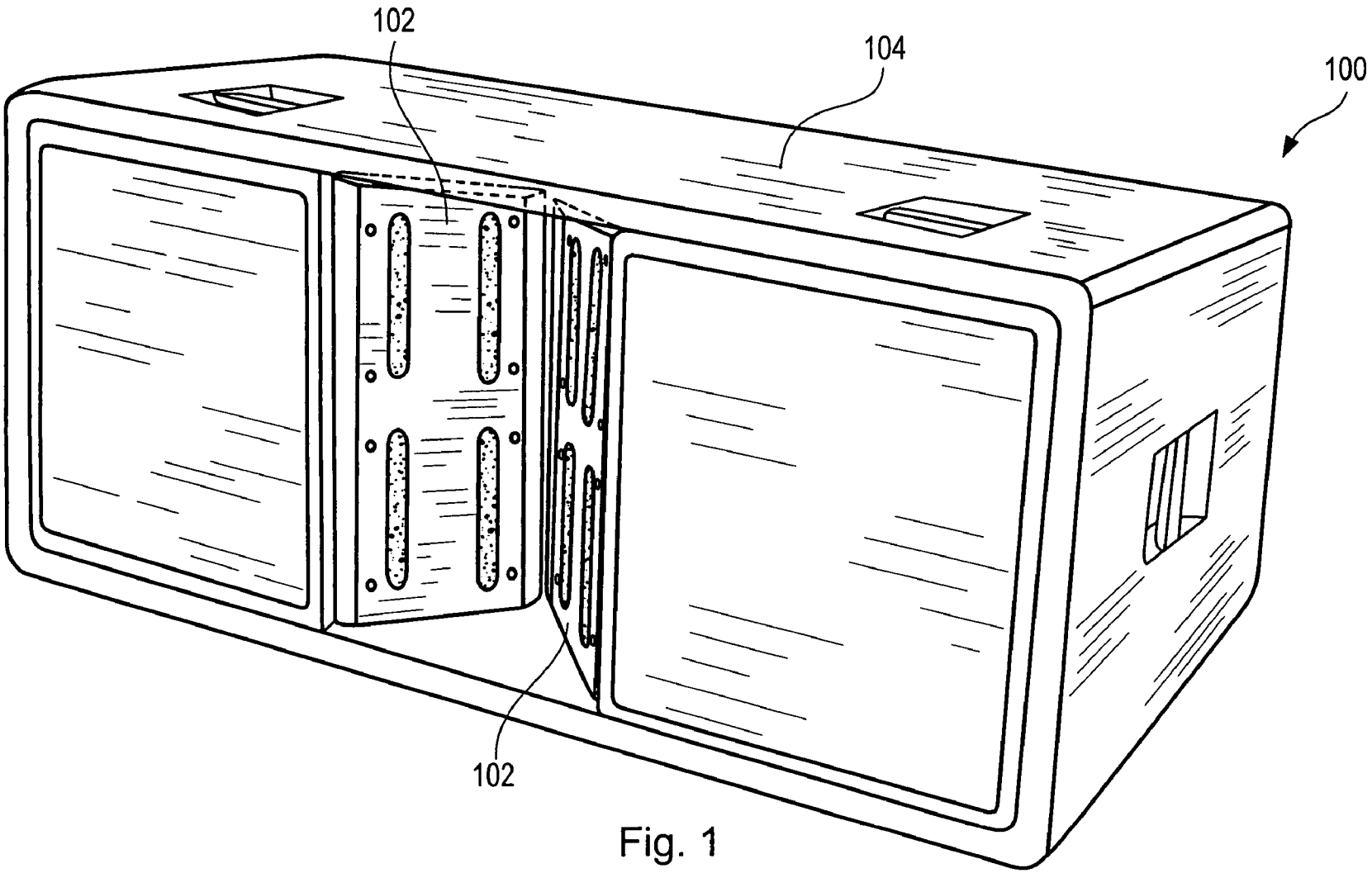
FIG. 1 is a perspective view of a sound integrator enclosed by a loudspeaker housing.

FIG. 1 illustrates a loudspeaker 100 that may utilize one or more sound integrators 102 to control sound. The sound integrators 102 are removably positioned within a housing 104 of the loudspeaker 100, but may also be permanently connected to the housing 104. The sound integrators 102 may be used to direct mid and high frequency sound to predetermined areas, such as directly toward listeners or locations within an auditorium. The sound integrators 102 may send substantially the same quality sound to listeners located in different parts of a venue.

Figure 2:
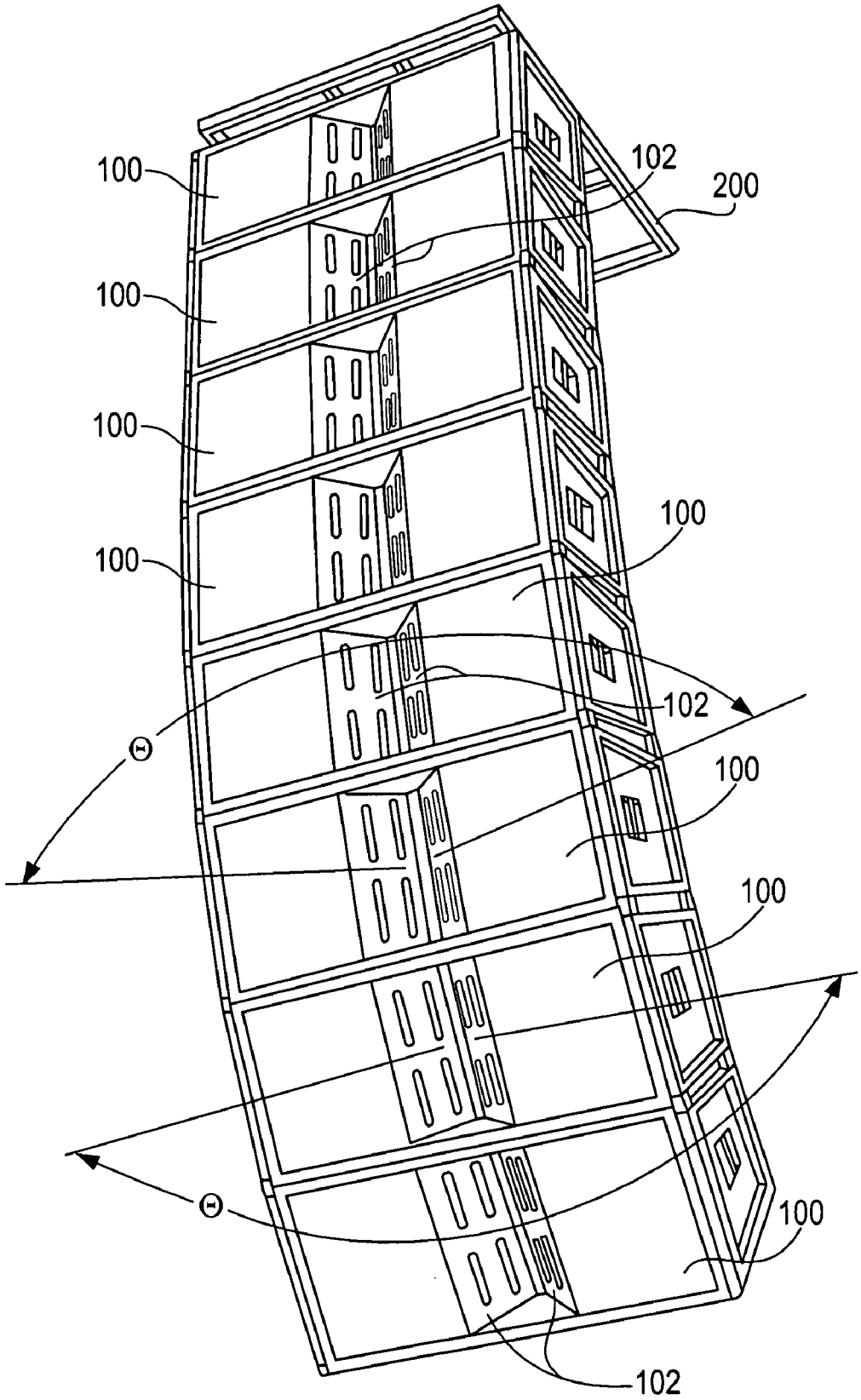
FIG. 2 is a perspective view of a series of the loudspeakers stacked together.

FIG. 2 illustrates a line array of loudspeakers 100. The loudspeakers may be arranged vertically on top of another or hung from an overhead support structure 200 within a venue. The arrangement shown in FIG. 1 is a line array speaker system. The loudspeakers 100 are suspended above an audience to form vertical lines of transducer arrays within the bass, mid-range and treble band passes. The speaker array may be curved to increase vertical angular coverage and to provide better control of the radiated sound. The sound radiating from the array may be further controlled by utilizing sound integrators 102 to control the direction angle θ, or angular coverage, of the sound radiated from one or more of the loudspeaker enclosures. The controlled direction may include the horizontal direction, and can also include any other direction such as the vertical direction or an oblique direction. The angular coverage may vary from loudspeaker 100 to loudspeaker 100 within the array. As such, the loudspeakers 100 arranged near a top of the array may provide one coverage angle and the loudspeakers 100 arranged near a bottom of the array may provide a different coverage angle.

Figure 3:
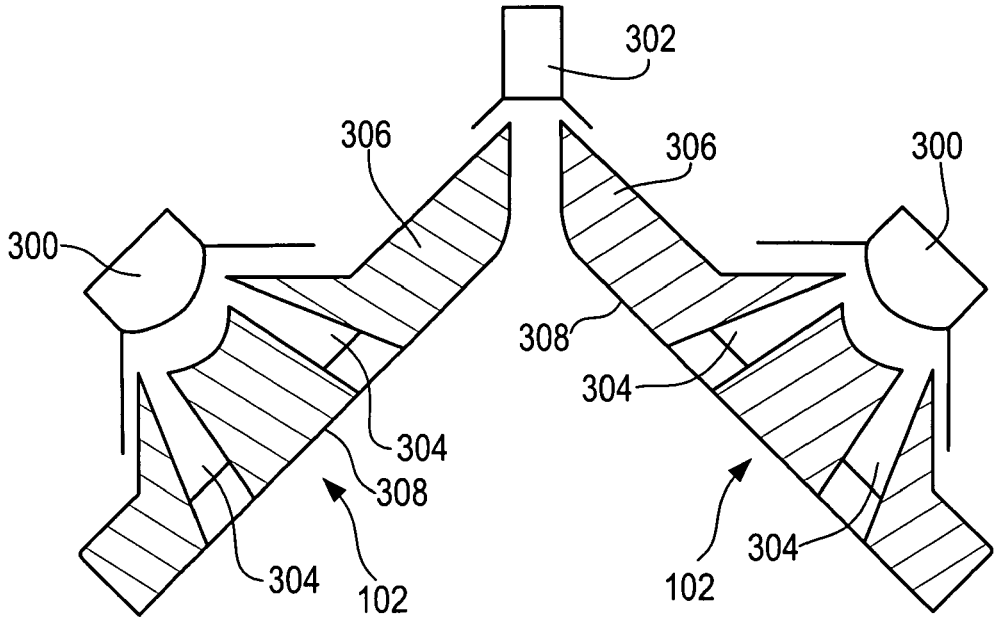
FIG. 3 is a cross-sectional side view of two sound integrators positioned over the respective mid-range frequency sound sources.
Figure 4:
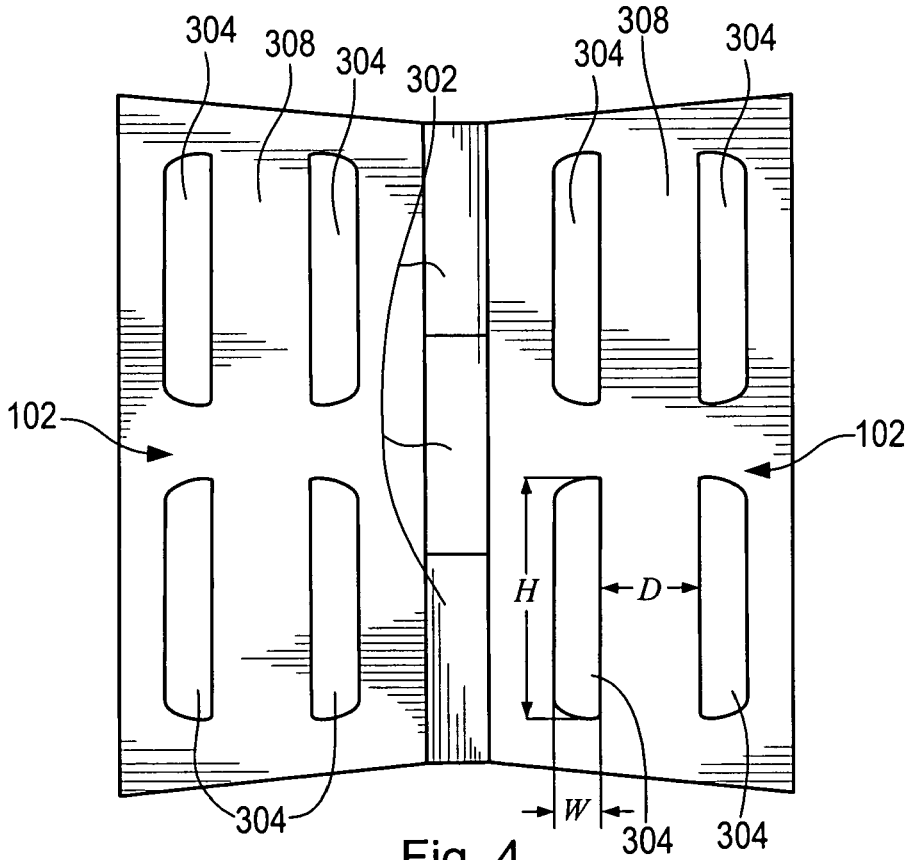
FIG. 4 is a front view of three vertical high frequency sound sources located between two sound integrators.

FIGS. 3 and 4 illustrate example sound integrators 102. In a three-way loudspeaker system, such as one with a mid-range frequency source 300, a high frequency source 302, and a low-frequency sound source, the sound integrators 102 may be positioned over the mid-range frequency sources 300. Other arrangements may also be used. All or a portion of the sound integrator 102 may be constructed of a porous material that allows sound from one or more sound sources to pass through it. Although accommodations for three high frequency sound sources 302 and four mid-range frequency sound sources 300 are illustrated, any number of mid-frequency and high frequency sound sources may also be used. A mid-frequency sound source 300 may produces frequencies between approximately 200 Hz and 2000 Hz. The high frequency sound source 302 may produce frequencies above approximately 1000 Hz. Other frequencies may also be used.

The high frequency sound sources 302 may be positioned between the sound integrators 102. The low frequency sound sources may be positioned to the sides of the sound integrators 102. The sound integrators 102 may provide a substantially solid boundary for the high frequency sound waves produced by the high frequency sources 302 and may allow mid-range sound waves from the mid-range sources 300 to pass through. The sound integrator 102 may include slots 304 or other openings, or may include no openings. The high frequency sound waves pass along a substantially smooth surface to integrate the sound waves radiating from both the high and mid-range frequency sound sources for better sound control and to minimize distortion of the high frequency sound wave front shapes. The sound integrator 102 may also act as a volume displacement device to improve loading and efficiency of the mid-range frequency elements.

The high frequency sound sources 302 generate high frequency energy or sound waves, which propagate across the sound integrators 102. The surfaces of the sound integrators 102 are angled relative to each other with the exception of a leading section 306. The leading section 306 forms a smooth transition to the outer surface 308 of the sound integrator 102. The sound integrators 102 are positioned adjacent to each other forming an angle relative to each other to function as a smooth wave-guide for the high frequency sound waves generated by the high frequency sound sources 302. The sound integrators 102 may by positioned at a predetermined angle to control a direction of the high frequency sound waves generated from the high frequency sound sources 302.

The outer surface 308 of the sound integrators 102 may be shaped to project sound from a sound source at predetermined angles depending on the shape of the outer surface 308. The angular direction of the projected sound waves may be varied with the sound integrators 102 even though the shape of the enclosure 104 of the loudspeaker 100 remains fixed. In one example, sound is radiated from the loudspeaker 100 at an angle of about 60 degrees from the loudspeaker 100. In another example, sound integrators 102 may be used to control the projection of sound at an angle of about 120 degrees.

FIG. 4 illustrates four slots 304 formed within a sound integrator 102. The slots may be configured into an elongated rectangle and formed within four quadrants, e.g., an upper right, an upper left, a bottom right, and a bottom left quadrant. The width "W" of the slots 304 may vary or range from about one-half inch to about 1 inch. The distance "D" between the two slots 304 may also vary or range from about two to about four times size of the width "W". One configuration has support D equal to almost W×(about two to about four). If W is equal to almost 1 inch, then D may be between about 2 to about 4 inches. In one configuration, the width "W" is about 13/16-inch (about 2.0 cm) and the distance "D" is about 2 9/16 inches (about 6.5 cm). The height "H" of the slots 304 may be configured to substantially equal to the diameter of the mid-range frequency sound source 300.

FIGS. 3 and 4 illustrate a horizontal cross-section view and a front view, respectively, of the sound integrator 102 having slots 304 passing through the sound integrator 102. The slots 304 act as a cavity that interferes with high frequency sound waves passing along the outer surface 308.

To minimize possible cavity effects, the slots 304 may be filled with a porous material 500, such as open cell foam, as illustrated in FIGS. 5-10. When filled with foam, the sound integrator 102 acts as a substantially solid boundary layer to the high frequency sound waves generated by the high frequency sound source 302. FIG. 5-9 illustrates various views of sound integrator 102 and the foam. Foam pieces 500 may be shaped to fit the slots 304, and may be inserted into the slots 304 to create a substantially solid acoustic surface for the high frequency energy radiating from the high frequency sound source 302.

The open cell foam 500 may be substantially transparent to mid-range frequency sound waves to allow such waves to pass through the slots 304. The foam 500 may be acoustically solid to high frequency sound waves to substantially block high frequency sound waves that normally pass through the foam. Some foam piece have a porosity between almost 60 PPI and almost 100 PPI. A foam section, having a porosity of about 80 PPI, may be ideal for appearing transparent to mid-range frequencies. Besides foam, many other porous material may also be used. The use of open cell foam 500 in the slots 304 may also act as a low pass filter for the higher frequencies of the mid-range sound source 300. Such low frequencies would otherwise pass through the slots 304, possibly interfering with the sound produced by the high frequency sound sources 302.

Figure 5:
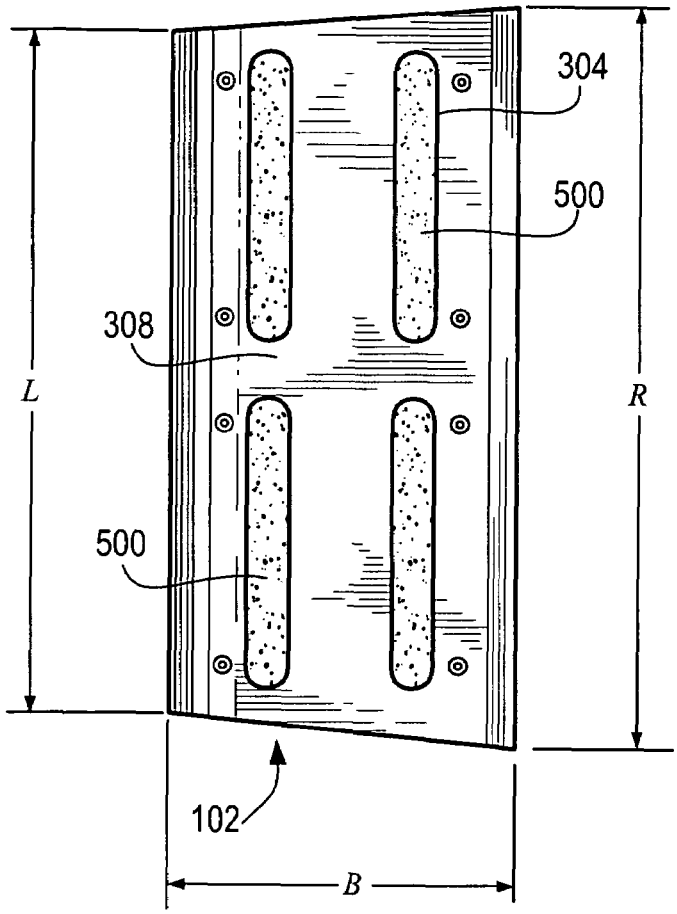
FIG. 5 is a front view of a sound integrator having foam covering multiple slots.
Figure 6:
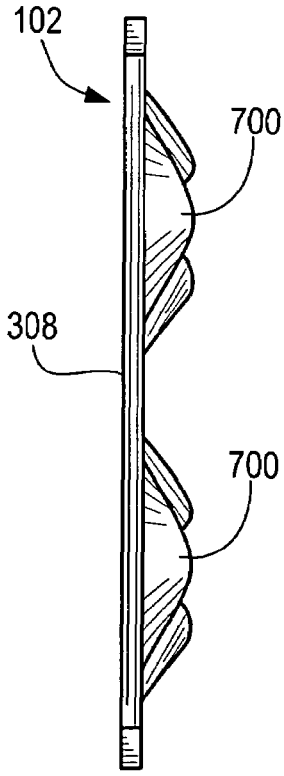
FIG. 6 is a side view of the sound integrator illustrated in FIG. 5.
Figure 7:
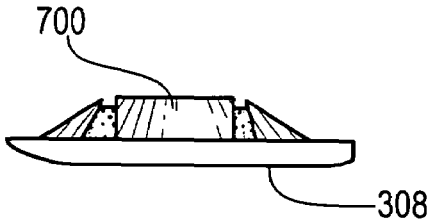
FIG. 7 is a bottom view of the sound integrator illustrated in FIG. 5.
Figure 8:
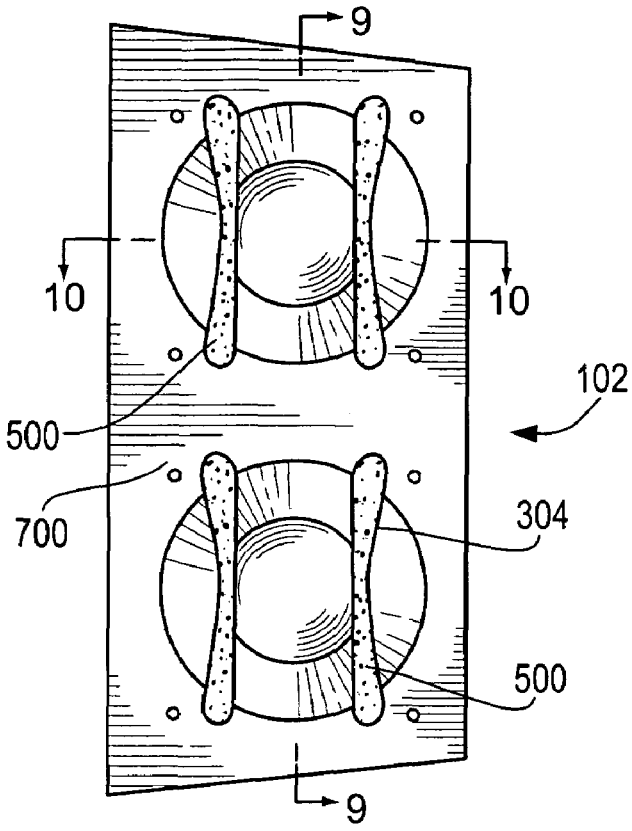
FIG. 8 is a rear view of the sound integrator illustrated in FIG. 3.

As shown in FIG. 5, the sound integrator 102 may be sized to substantially cover the mid-range frequency sound sources 300 and to provide a substantially solid boundary layer for the high frequency sound waves from the sound sources 302. The right side "R" length may be a greater length than the left side "L" length so that the space between the two sound integrators 102 expands in the lateral and vertical directions to disperse the sound.

Figure 9:
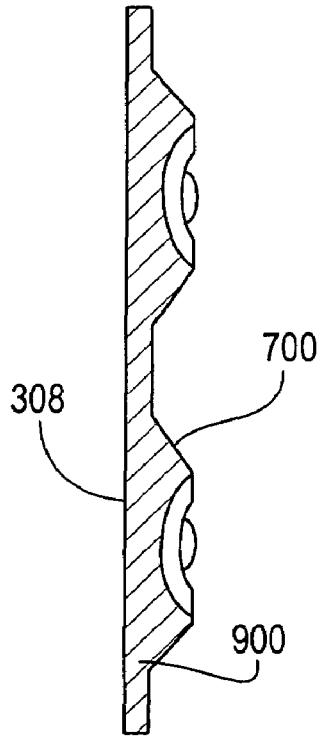
FIG. 9 is a cross-sectional view of the sound integrator taken along line 9 of FIG. 8.

As shown in FIG. 9, surfaces of the sound integrator 102 include the outer surface 308 and an inner surface 700. The outer surface 308 and the inner surface 700 may be manufactured from a variety of materials that provide an acoustical boundary to the high frequency energy generated by the high frequency sound source 302. As illustrated in FIGS. 5-10, the surfaces of the sound integrator 102 may be made of other materials, such as vacuum formed from plastic.

The sound integrator 102 may be manufactured as an outer and an inner surface and include foam 900 positioned between its outer surface 308 and its inner surface 700, to be acoustically inert for damping purposes. The foam 900 may prevent the sound integrator 102 from providing or exhibiting resonance. The use of foam 900 in the construction of the sound integrator 102 may also reduce the weight of the sound integrator 102.

The sound integrator 102 may also serve as a volume displacement device creating a loading of mid-range frequencies originating from the mid-range frequency sound sources 300. Volume displacement attenuates the higher frequencies, while improving the efficiency at the lower mid-range frequencies. The inner surface 700 of the sound integrator 102 may be juxtaposed near the cone of the mid-range sound source 300 without coming into contact with the cone. The space in front of the mid-range sound source 300 may be substantially closed except for the acoustically transparent slots located near the sound integrator 102. As such, the sound integrator 102 loads the mid-range frequency sound source by making a substantial portion of the cone surface oppose a solid surface leading to the slots 304. The acoustic load in front of the cone may be greater with the sound integrator covering the sound source 300 when compared to its operation in open air without the sound integrator 102. This effectively transforms the mid frequency diaphragms to a larger equivalent air mass, thus increasing the efficiency of the acoustic system at the lower mid range frequencies.

As shown in FIGS. 6, 7, 9 and 10, the inner surface 700 may be formed to substantially mirror the shape of the cone and the dome shape of the mid-frequency sound sources 300. To minimize interference at the upper range of the middle frequencies, the inner surface 700 may be positioned adjacent to the mid-frequency sound sources 300 without the cone of the mid-frequency sound sources 300 ever touching the inner surface 700 of the cone. In one configuration the inner surface 700 may be separated from the mid-frequency sound sources 300 by about 0.2 to about 0.4 inches, such as about 0.375 inch.

Figure 10:
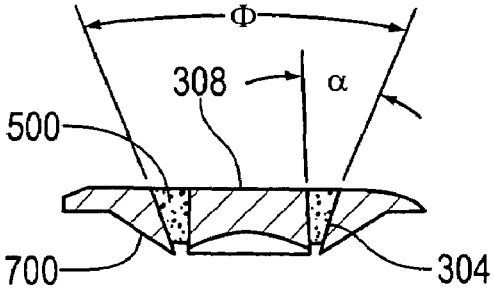
FIG. 10 is a cross-sectional view of the sound integrator taken along line 10 of FIG. 8.

As shown in FIG. 10, the slots 304 gradually expand from the inner surface 700 to the outer surface 308 of the sound integrator 102. An acute angle $\Phi$ may be formed between the two slots 304, and the slot 304 may expand to an acute angle $\alpha$. The angle $\Phi$ may range from between about 30° and about 50°, and in particular be about 40°. The angle $\alpha$ may range from about 15° to about 25°, and in particular about be 20°. Alternatively, the slot 304 may expand in a curved line to provide a smooth expansion from the inner portion to the outer portion.

Figure 11:
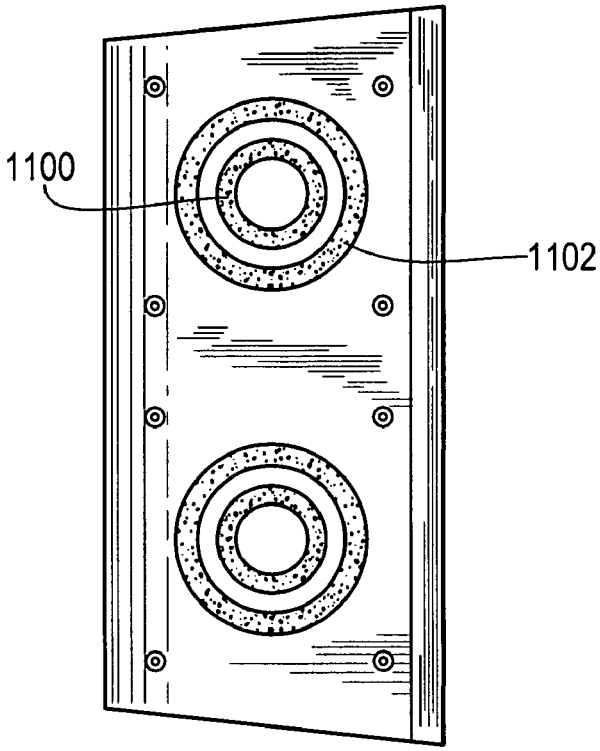
FIG. 11 is a front view of an alternative sound integrator having circular slots.
Figure 12A:
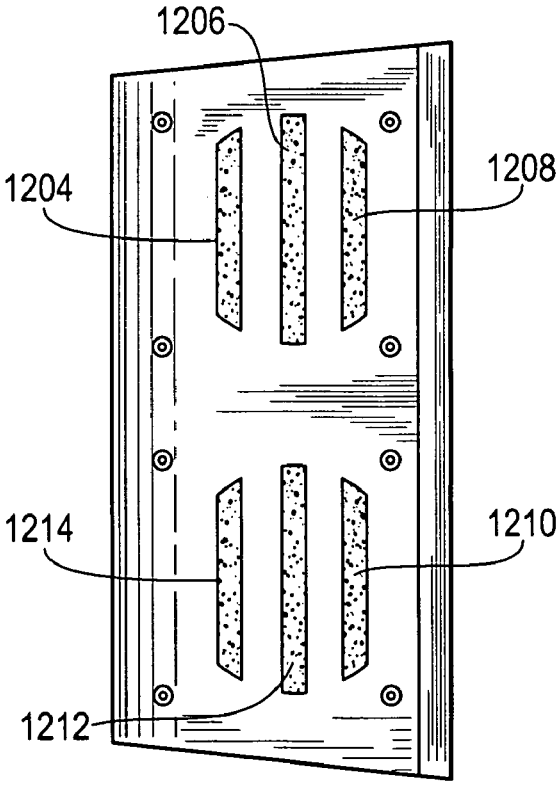
FIG. 12A is a front view of a second alternative sound integrator having six slots.
Figure 12B:
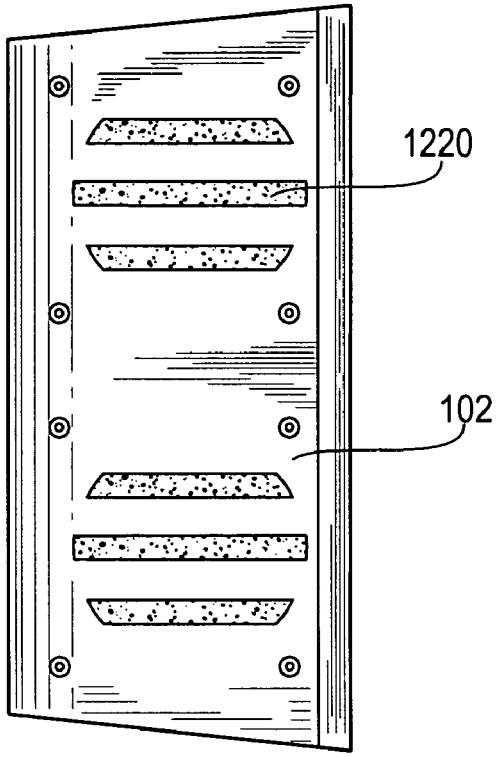
FIG. 12B is a front view of a third alternative sound integrator having horizontal slots.
Figure 12C:
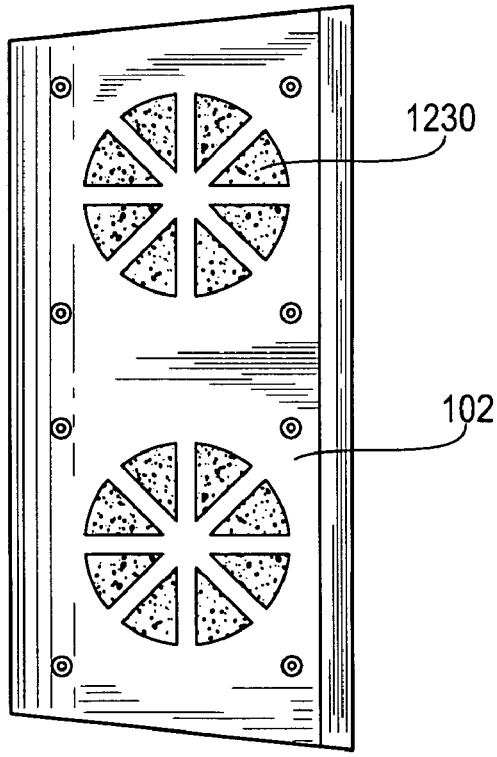
FIG. 12C is a front view of as fourth alternative sound integrator having radial slots relative to the mid-range loudspeakers.
Figure 12D:
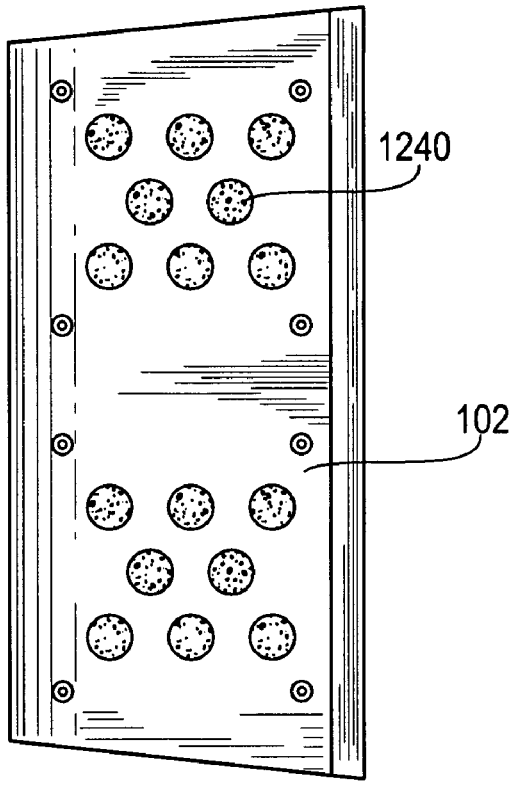
FIG. 12D a front view of a fifth alternative sound integrator having small holes.
Figure 12E:
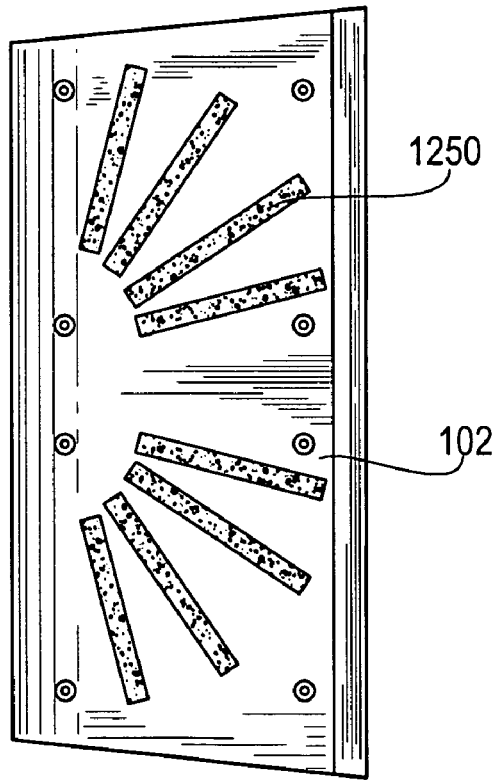
FIG. 12E is a front view of a sixth alternative sound integrator having radial slots relative to the high frequency radiation aperture.

FIGS. 11 and 12A-E illustrate a front view of a sound integrator 102 with alternative slots formed within the sound integrator 102. The number of slots and configuration of the slots may vary in size and shape so that the surface of the sound integrator 102 is almost acoustical solid to high frequency sound. FIG. 11 illustrates a smaller circular slot 1100 filled with foam within a larger circular slot 1102 also filled with foam. FIG. 12A illustrates a six slot configuration with slots 1204, 1206, 1208, 1210, 1212, and 1214 within the sound integrator 102, where each of the slots 1204, 1206, 1208, 1210, 1212 and 1214 has a smaller width than the slots 304 shown in FIG. 3. FIG. 12B illustrates a series of horizontal slots 1220 formed within sound integrator 102. FIG. 12C shows a configuration of a sound integrator 102 using radial slots 1230 above the mid-range frequency loudspeakers. FIG. 12D shows a configuration of a sound integrator 102 using a series of apertures or generally round shaped slots 1240 positioned above the mid-range frequency loudspeakers. FIG. 12E illustrates a configuration having radial slots 1250 positioned relative to the high frequency radiation aperture. The sound integrator 102 may also be configured to have one continuous slot such as a slot forming an "I", "O," "S," "Z" shape among many others.

Figure 13:
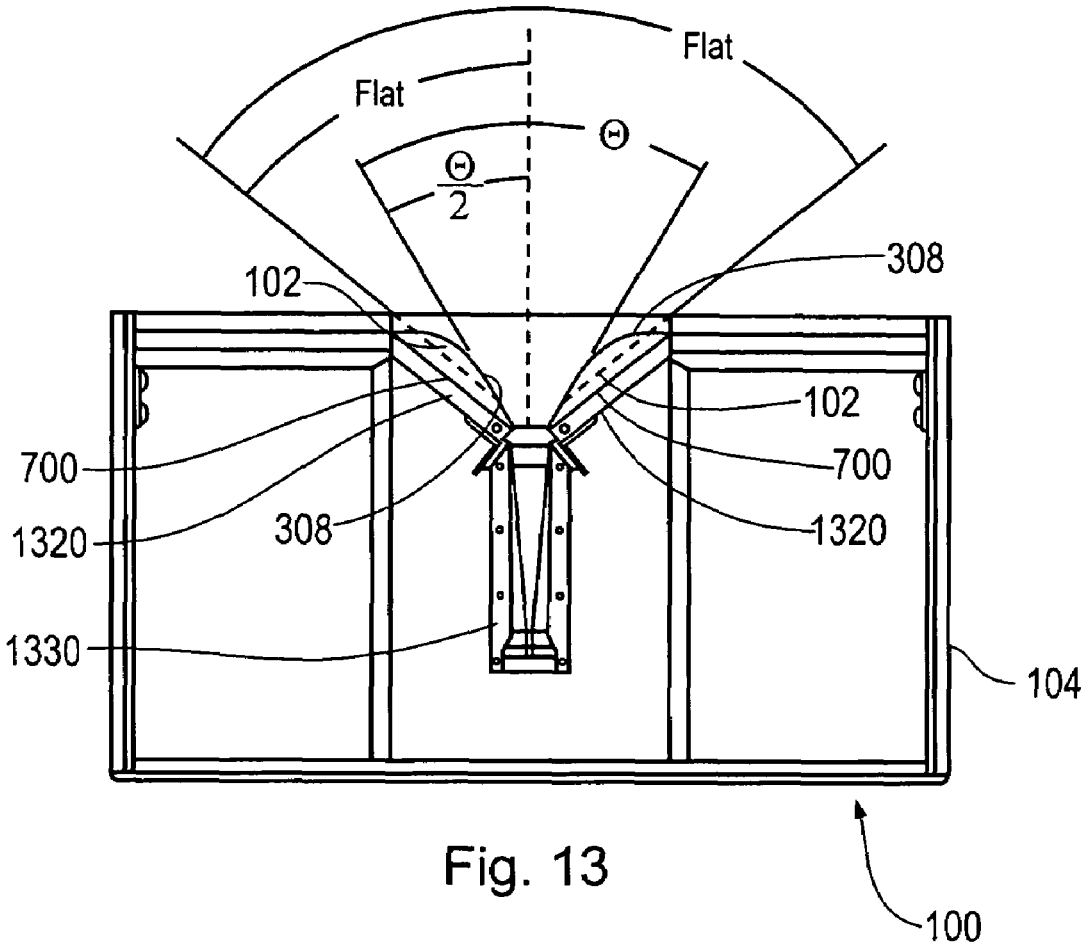
FIG. 13 is a horizontal cross-section view of a loudspeaker enclosure incorporating sound integrators having planar and curved outer surfaces.

FIG. 13 illustrates a horizontal cross-section view of a loudspeaker enclosure 104 incorporating sound integrators 102 with the outer surfaces 308 including planar and curved shapes designed to project sound at a specified angle $\theta$. The sound integrator 102 is implemented by its position relative to the enclosure 104 of the loudspeaker system 100. The sound integrator 102 may also be implemented in many other ways, such as with high frequency and/or low frequency sound sources positioned in the wall of a dwelling.

When used with the loudspeaker system, the sound integrator 102 may be positioned adjacent to a midrange baffle 1320 of the loudspeaker 100. The loudspeaker 100 includes a high frequency sound source 302, such as horn 1330, positioned to project sound between sound integrators 102. The shape of the outer surface 308 of the sound integrator 102 is utilized to direct sound at predetermined angles, without having to change the shape of the enclosure 104. The shape may be used to direct sound to a predetermined area while the shape of the enclosure 104 would otherwise direct sound to another area. The sound may also be directed at other angles, such as at about 120 degree.

Different shaped sound integrators 102 may be used so that sound radiation of the high frequency horn 1330 is projected at a predetermined angle to optimize the performance of the loudspeaker system to a particular application. The sound integrators 102 may be removably attached to the enclosure 104 of the loudspeaker 100 using fasteners, such as bolts and/or screws. The sound integrators 102 may also be changed and/or interchanged with existing loudspeaker systems to vary the angle of projected sound. Additionally, a sound integrator 102 may be constructed to vary the angle of projected sound without removing the sound integrator 102 from the loudspeaker 100. The outer surface 308 of the sound integrator 102 may be flexible and the mechanics of the sound integrator 102 may be used to vary the shape of the outer surface 308 to project sound at varying angles.

Figure 14:
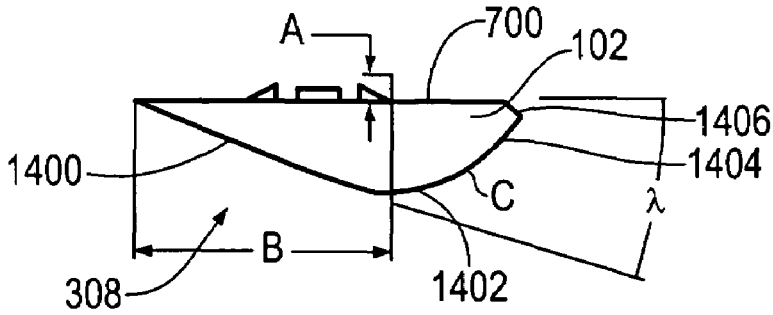
FIG. 14 is a bottom view of a sound integrator of FIG. 13 having about a 60 degree sound radiation angle.

FIG. 14 illustrates a bottom view of an example sound integrator 102 for producing about a 60 degree sound radiation angle. Referring to FIGS. 13 and 14, the inner surface 700 is positioned adjacent to the mid-range frequency source 300, separated by a distance A, such as about 0.45 inches. The outer surface 308 of the sound integrator 102 includes a leading edge 1400, a top edge 1402 and an exit edge 1404. In this illustration, the leading edge 1400 is a planar edge. The leading edge 1400 rises at determined angle λ, such as about a 20 degree angle from the inner surface 700. The top edge 1402 curves to form an exit edge 1404 at a predetermined radius C, such as a radius of about 1.79. An apex of the top edge 1402 occurs at a distance B, such as about 3.71 inches, from the beginning of the leading edge 1400. When assembled to the housing 104, portion 1406 is shaped to abut the housing 104 of the loudspeaker 100.

The dimensions of the sound integrators 102 may vary with the implementation such as a size of the enclosure 104 and a desired coverage angle. The physical shape of the sound integrator 102 may be fixed or changeable. Movement may occur when an elastic covering, or pivot is used. Different coverage angles can be achieved by interchanging sound integrators 102 or by including a mechanism within the sound integrator 102 to change its shape. The leading edge 1400 is arranged such that the sound radiation from the sound sources 300 and 302 substantially follows the shape of the top edge 1402 of the sound integrator 102. The exit edge 1404 is shaped such that the sound radiation is smoothly transformed from the prescribed coverage angle to the half space boundary condition of the enclosure 104.

Figure 15:
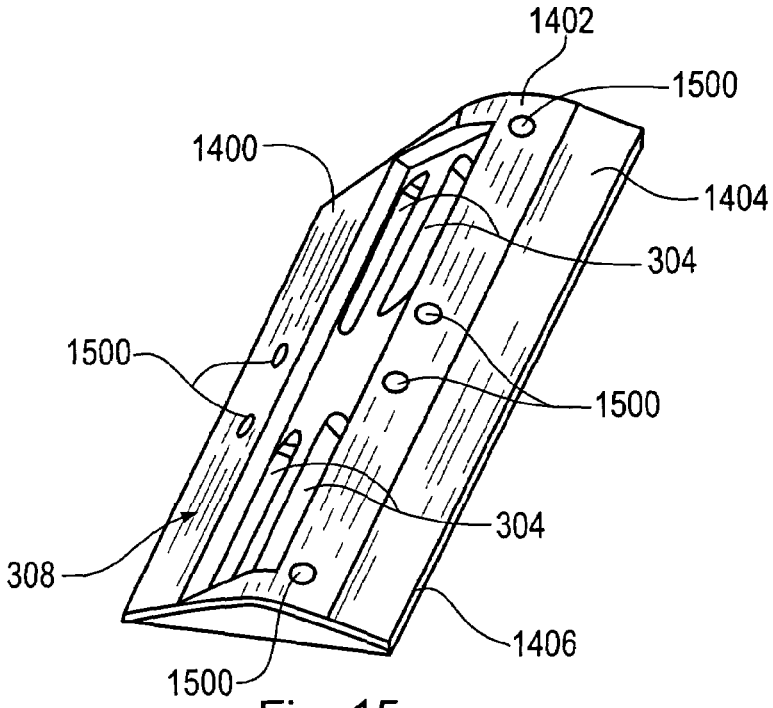
FIG. 15 is a perspective view of the sound integrator of FIG. 13 having a curved and planar outer surface.

FIG. 15 illustrates a perspective view of the sound integrator 102 of FIGS. 13 and 14. The sound integrator 102 includes slots 304, four are shown, but more or less may be used depending on its implementation. The slots 304 may or may not be filed with foam 500 (e.g. FIG. 5). The sound integrator 102 may also include fastener holes 1500, to allow for attachment to and removal from the housing 104 of the loudspeaker system. The sound integrator 102 may be fastened to the loudspeaker system with bolts or other fasteners, such as screws, allowing sound integrators 102 to be interchanged.

Figure 16:
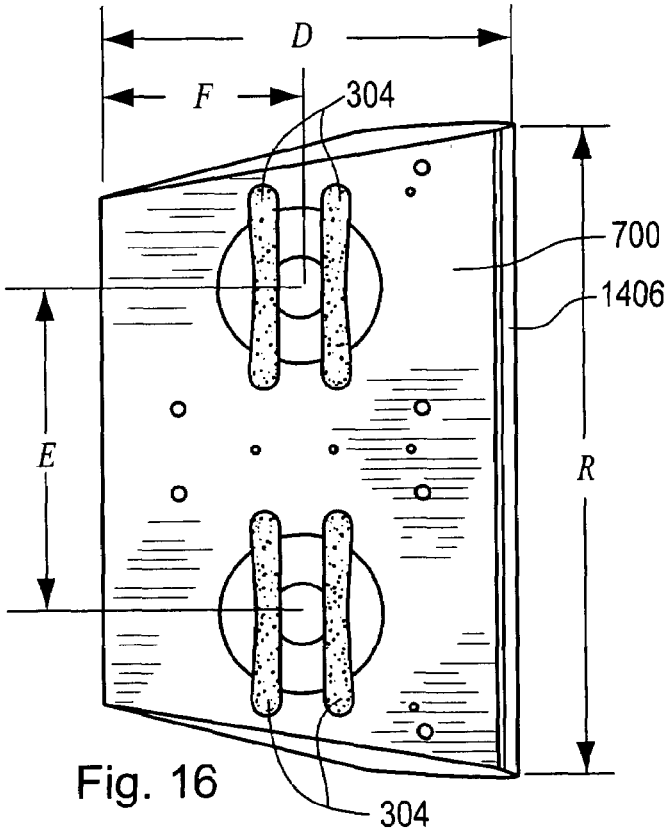
FIG. 16 is an rear view of the sound integrator of FIG. 13.

FIG. 16 illustrates a view of the inner surface 700 of the sound integrator 102 of FIGS. 13 and 14. The sound integrator 102 includes a base length "D", such as about 5.65 inches and a major side length "R", such as about 9.10 inches. The vertical center of a pair of slots 304 is located a distance E, about 4.50 inches, from a second pair of slots. The horizontal center of the slots 304 are located a distance F, such as about 2.95 inches from the left side of the sound integrator 102. Other dimensions may also be used depending on its implementation.

Figure 17:
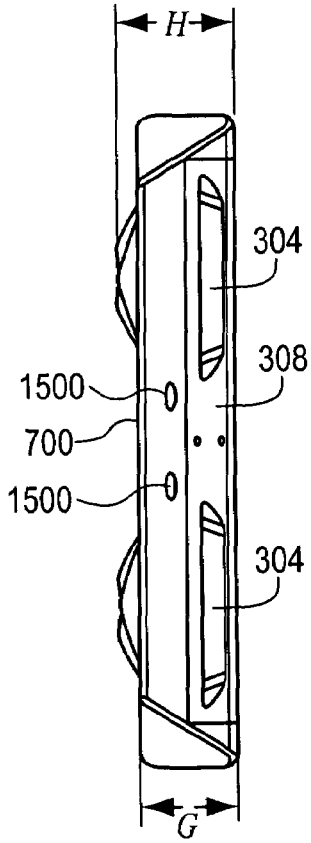
FIG. 17 is a side view of the sound integrator of FIG. 13.

FIG. 17 illustrates a side view of the sound integrator 102. The sound integrator 102 may include a depth of distance G, such as 1.34 inches from the peak of the outer surface 308 to the flat of the inner surface 700. The sound integrator 102 may also include a width of distance H, such as 1.6 inches from a peak of the outer surface 308 to a innermost point of the inner surface 700.

Figure 18:
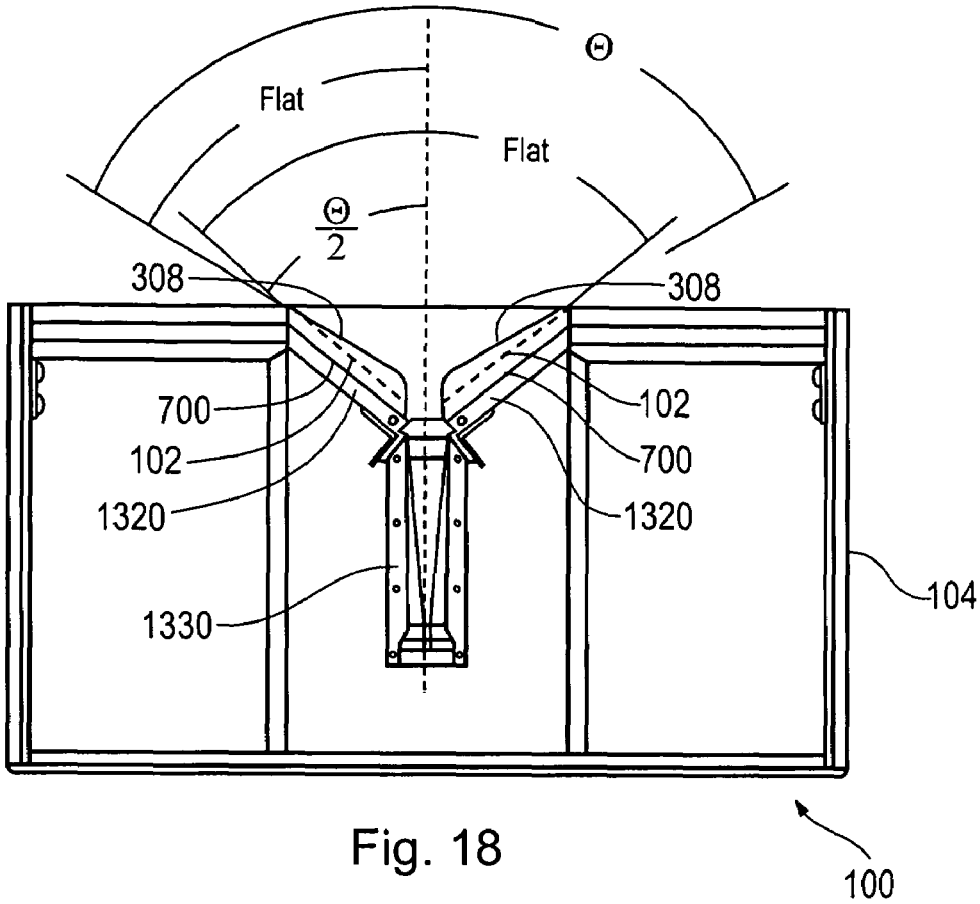
FIG. 18 is a horizontal cross-section view of the loudspeaker enclosure incorporating sound integrators having an alternate outer surface.

FIG. 18 illustrates a horizontal cross-section view of a sound integrator 102 with the outer surface 308 having a planar and curved shape designed to project sound at a specified angle, such as 120 degrees. The sound integrator 102 is positioned on the housing 104 of the loudspeaker 100, adjacent to a midrange baffle 1320. The loudspeaker system includes a high frequency horn 1320 positioned to radiate high frequency sound between the sound integrators 102. The shape of the outer surface 308 of the sound integrator 102 directs sound radiation at a predetermined angle, without having to change the shape of the housing 104 of the mid-range frequency baffle 1320. The shape illustrated in FIG. 18 may be used to control sound radiation through an angle of 120 degrees. The shape of the sound integrator 102 may also be changed to control sound radiating through other angles.

Figure 19:
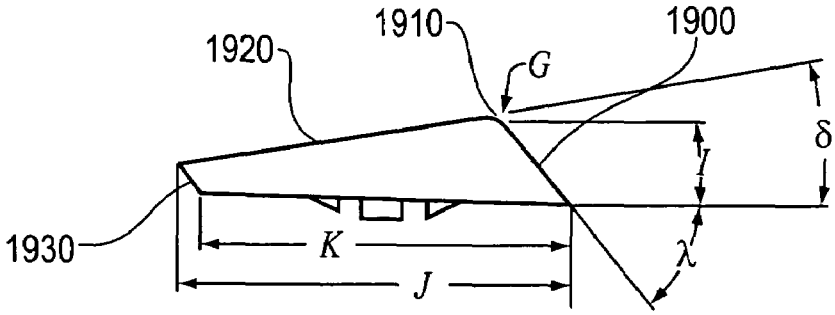
FIG. 19 is a bottom view of a sound integrator of FIG. 18 having about a 120 degree sound radiation angle.

FIG. 19 illustrates a bottom view of the sound integrator 102 of FIG. 18. Referring to FIGS. 18 and 19, the inner surface 700 of the sound integrator 102 is positioned adjacent and generally parallel to the midrange baffles 1320, at a distance A, such as about 0.45 inches, away from the midrange baffle 1320. The outer surface 308 of the sound integrator 102 includes a leading edge 1900, a top edge 1910, and an exit edge 1920. In this case, the exit edge 1920 includes a planar surface. The leading edge 1900 of the outer surface 308 rises at a predetermined angle λ such as about a 50 degree angle. The top edge 1910 curves at a predetermined radius G such as a radius of about 0.5 from a point about 0.73 inches above the inner surface 700 and about 1.21 inches from a beginning point of the rising portion 1900. An apex of the top edge 1910 occurs at a distance I of about 1.23 inches, above the inner surface 700.

The exit edge 1920 descends at an angle δ of about 10 degrees. A tip of the exit edge 1920 is a distance J, such as about 5.69 inches from a beginning point of the leading edge 1900 along the inner surface 700. When assembled to the housing 104 of the loudspeaker 100, exit edge 1930 is positioned above the midrange baffle 1320, against a surface of the loudspeaker system. The end part 1930 joins the inner surface 700 at a distance K, such as about 5.37 inches from the beginning point of the inner surface 700.

Figure 20:
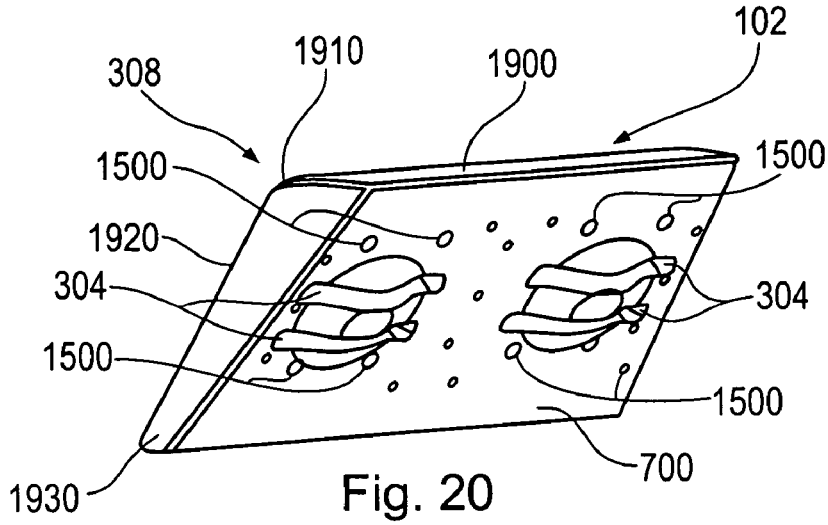
FIG. 20 is a rear perspective view of the sound integrator of FIG. 18.

FIG. 20 illustrates a perspective view of the sound integrator 102. The sound integrator 102 includes slots 304. Four slots 304 are shown, but more or less may be used depending on the application. Some application use no slots. The slots 304 may or may not be filed with foam 48 (e.g. FIG. 3). The sound integrator 102 may also include fastener holes 1500, to allow for the sound integrator 102 to be attached to and removed from the enclosure 104 of the loudspeaker 100. The sound integrator 102 may be removably fastened to the loudspeaker 100 with bolts or other fasteners, such as screws.

Figure 21:
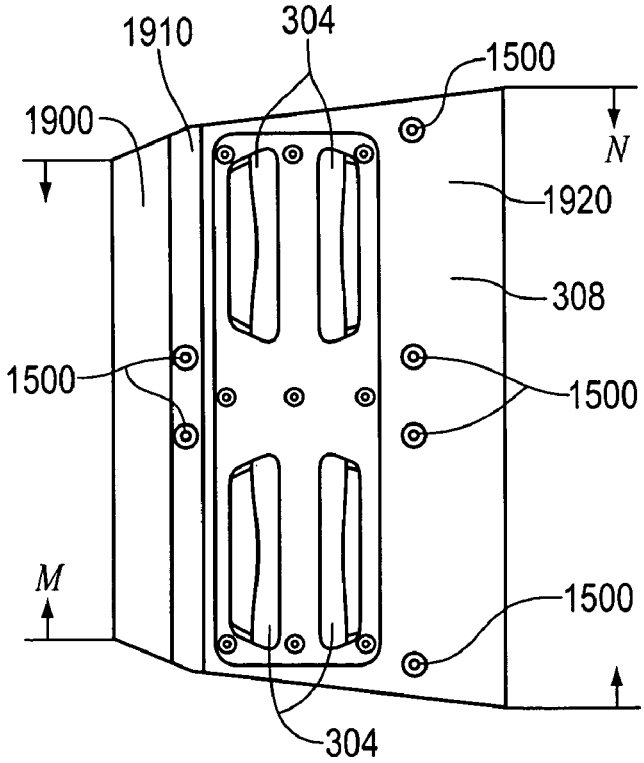
FIG. 21 is a front view of the sound integrator of FIG. 18.

FIG. 21 illustrates a front view of the sound integrator 102. The sound integrator 102 includes a major side length "N", such as about 9.08 inches and a minor side length "M, such as about 7.13 inches. The vertical center of one pair of slots 304 is located a distance, such as about 4.50 inches from a second pair of slots. The horizontal center of the slots 304 is located a distance, such as about 3.02 inches from the major side of the sound integrator 102.

Figure 22:
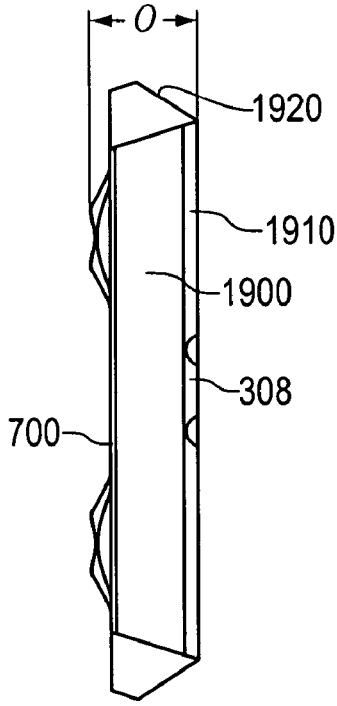
FIG. 22 is a side view of the sound integrator of FIG. 18.

FIG. 22 illustrates a side view of the sound integrator 102. The sound integrator 102 may include a width of a distance O, such as about 1.50 inches from the peak of the outer surface 308 to an innermost point of the inner surface 700.

Figure 23:
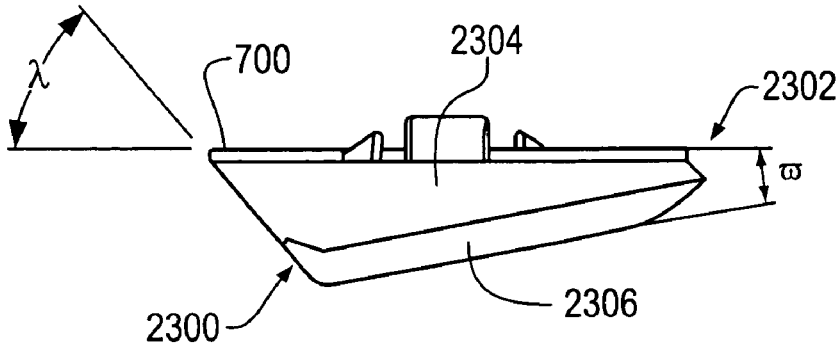
FIG. 23 is a bottom view of a two piece sound integrator.

FIG. 23 illustrates a bottom view of a two piece sound integrator 102 including a first piece 2300, such as a base, and a second piece 2302, such as a cover. The leading edge 2300 rises at determined angle λ, such as about a 50 degree angle from the inner surface 700. The exit edge 2302 descends at an angle ω of about 10 degrees. A gasket may be positioned between the first piece 2300 and the second piece 2302, or the first piece 2300 and the second piece 2302 may be directly connected.

Figure 24:
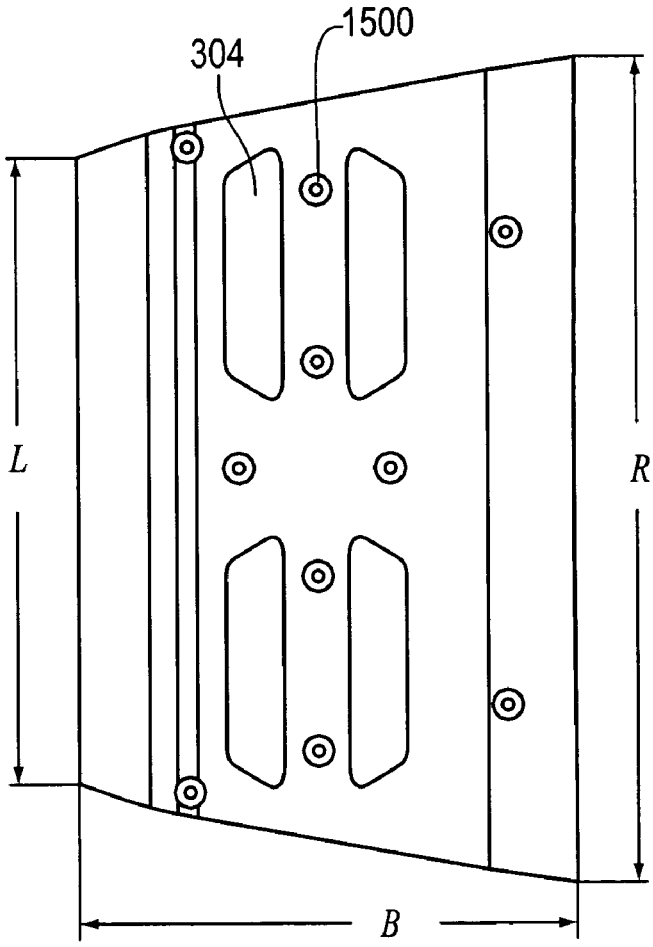
FIG. 24 is a front view of the sound integrator of FIG. 23.

FIG. 24 illustrates a front view of the two piece sound integrator 102. The sound integrator 102 may be sized to substantially cover the mid-range frequency sound sources 300 and to provide a substantially solid boundary for the sound radiation from the high frequency sound sources 302. For a particular sized loudspeaker 100, the major side "R" may include a length of about 9.57 inches and the minor side "L" may include a length of about 7.32 inches. Other sizes may also could be used. The base "B" may include a length of about 5.67 inches.

Figure 25:
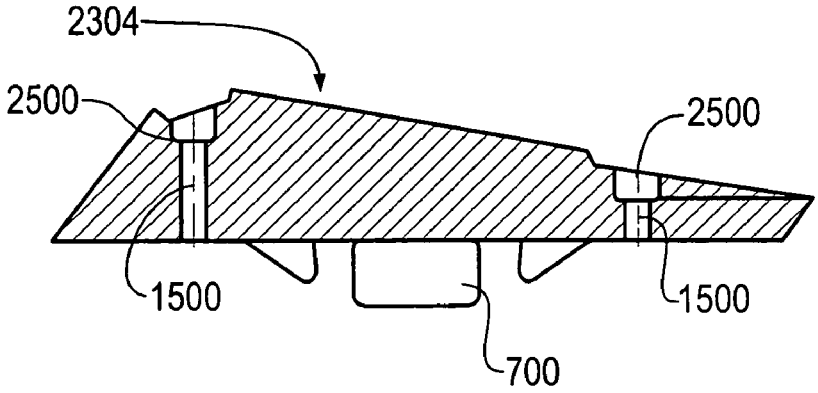
FIG. 25 is a horizontal cross-sectional view of the body of the sound integrator of FIG. 23.

FIG. 25 illustrates a horizontal cross-section view of the base piece 2304 of the sound integrator 102. Fastener holes 1500 may be provided through the sound integrator 102 such that the sound integrator 102 may be fastened to and removed from the enclosure 104 of the loudspeaker 100. The fastener holes 1500 may include bored recesses 2500 to accommodate a bolt head of a fastener bolt.

Figure 26:
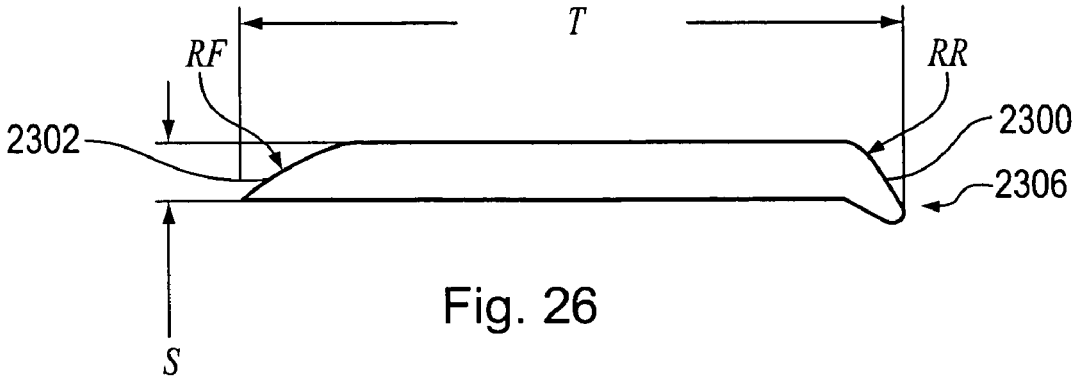
FIG. 26 is a horizontal cross-sectional view of the cover of the sound integrator of FIG. 23.

FIG. 26 illustrates a horizontal cross-section view of the cover piece 2306 of the sound integrator 102. The cover piece 2306 may include a thickness S, such as 0.39 inches. The rising edge may include a radius RR, such as about 0.25 and the falling edge may include a radius RF, such as about 1.70. The distance from rising end 2300 to falling end 2302 may include a length T, such as 4.88 inches.

Figure 27:
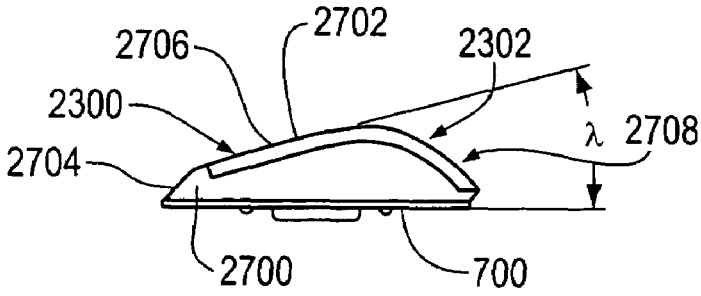
FIG. 27 is a bottom view of a two piece sound integrator.

FIG. 27 illustrates a front bottom view of a two piece sound integrator 102. The sound integrator 102 includes a first piece 2700, such as a base piece, and a second piece 2702, such as a cover piece. A gasket may be positioned between the first piece 2700 and the second piece 2702. A first part 2704 of the leading edge 2300 rises at a predetermined angle, such as about 45 degrees. A second part 2706 of the leading edge 2300 rises at another predetermined angle λ, such as about a 15 degree angle from the bottom surface 700.

Figure 28:
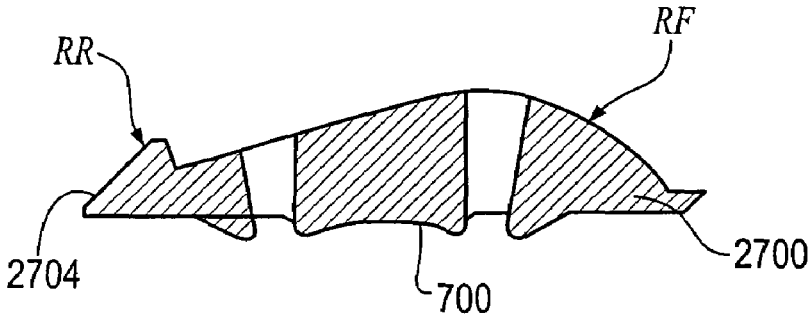
FIG. 28 is a horizontal cross-sectional view of the body of the sound integrator of FIG. 27.
Figure 29:
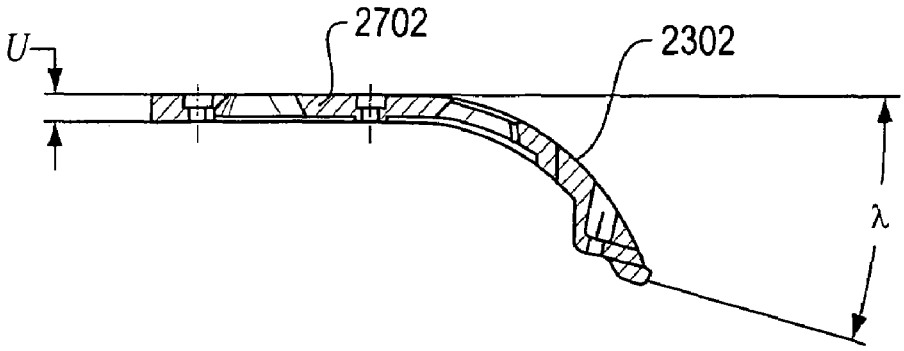
FIG. 29 is a horizontal cross-sectional view of the cover of the sound integrator of FIG. 27.

FIG. 28 illustrates a horizontal cross-section view of the base piece 2700 of the sound integrator 102 and FIG. 29 illustrates a back side cutaway view of the cover piece 2702 sound integrator 102. The transition between the first part 2704 and the second part 2706 of the leading edge 2300 may include a radius RR such as about 0.75. The radius of the exit edge 2302 may include a radius RF such as about 2.19. The cover piece 2702 may include a thickness U such as 0.3 inches.

Figure 30:
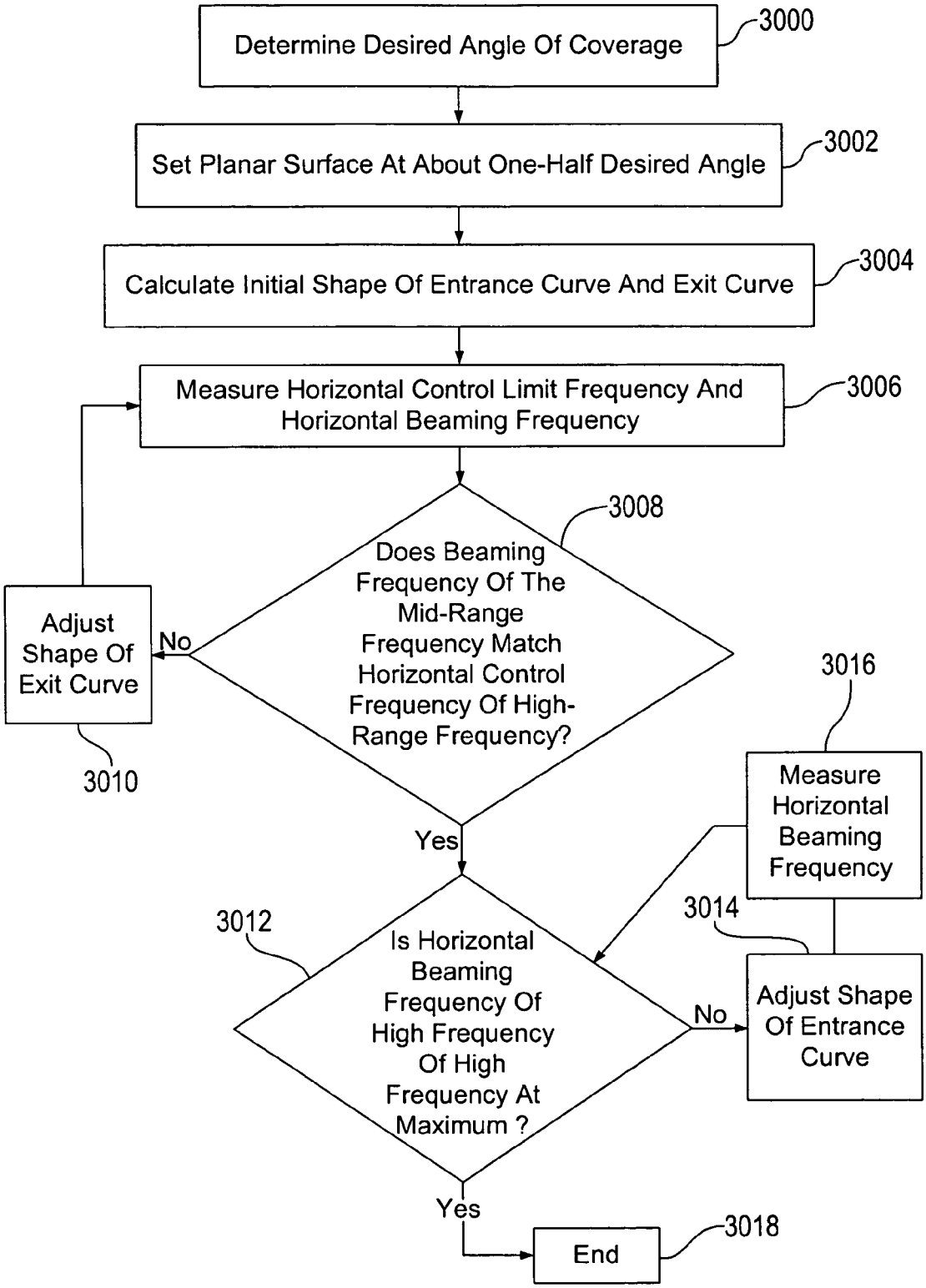
FIG. 30 is a flowchart for determining a shape of the sound integrator.

FIG. 30 is a flowchart illustrating a method for determining the shape of the sound integrator 102 for a specified angle. At block 3000, a desired coverage angle of the sound integrator 102 is determined. At block 3002, the planar surface of the sound integrator 102 is set at about one-half the desired coverage angle. If the desired coverage angle is about sixty degrees, the angle of the planar surface is set to about thirty degrees. A length of the planar surface is implementation dependent and may depend on the size of the enclosure 104 to accommodate the sound integrators 102. At block 3004, an initial shape of the entrance curve and exit curve are determined such as by calculating the curves using known techniques in the horn industry.

At block 3006, after the initial shape of the sound integrator 102 is determined, to further refine the shape of the sound integrator 102, the acoustical performance is measured. Acoustic measurements are collected on the axis of projection of the sound and up to about one hundred-eighty degrees off the axis to the projected sound. The horizontal control limit frequency and the horizontal beaming frequency are determined from the acoustic measurements. At block 3008, the horizontal beaming frequency of the mid-range frequency is compared to the horizontal control limit frequency of the high-range frequency. At block 3010, if the frequencies do not match the shape of the exit curve is adjusted. The shape of the exit curve of the sound integrator 102 may be physically adjusted using foam, clay, or an electronic model and shaving material from or adding material to the model. Additionally, a software application may be used to predict the horizontal control limit frequencies and horizontal beaming frequencies for the different shapes of the exit and entrance curves of the sound integrator 102. Thereafter, at block 3006, the horizontal control limit frequency can be re-measured. This process may be continued until the beaming frequency of the mid-range frequency approximately matches the horizontal control limit frequency of the high-range frequency, or until the frequencies become as close as possible due to the physical size and shape restraints imposed by the size and shape of the enclosure 104 of the loudspeaker system 100.

At block 3012, for particularly shaped entrance curves, the designer may determine if the horizontal beaming frequency of the high frequency is at a maximum. Determination of the maximum horizontal beaming frequency can be accomplished after matching the beaming frequency of the mid-range frequency to the horizontal control limit frequency of the high-range frequency. Maximizing the horizontal beaming frequency of the high frequency helps to ensure that listeners positioned off-axis of the loudspeaker system can hear high frequencies emanating from the loudspeaker 100. At block 3014, the entrance curve can be adjusted to maximize the beaming frequency of the emanating high frequency sound radiation. At block 3016, the horizontal beaming frequency can be re-measured after the shape of the entrance curve is adjusted. At block 3018, when the horizontal beaming frequency is maximized for a particular sound integrator 102, the shaping process may end.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A loudspeaker system including an enclosure comprising:

a high frequency sound source positioned within the enclosure to project high frequency sound;

a mid-frequency sound source positioned within the enclosure to project a mid-frequency sound;

a first surface positioned adjacent to the high frequency sound source, the first surface having a planar and a curved surfaces to control an angle of the projected high frequency sound where the angle is adjustable; and a second surface positioned over the mid-range frequency sound source.

2. The loudspeaker of claim 1 further including at least one slot positioned through the first and second surfaces.

3. The loudspeaker of claim 1 where the radiation angle is adjustable.

4. The loudspeaker of claim 1 where the radiation angle is controlled in a generally horizontal direction.

5. The loudspeaker of claim 1 where the first surface is removable.

6. The loudspeaker of claim 1 wherein an angle of sound radiation from the first and second surfaces differs from an angle of sound radiation projected from the enclosure of the loudspeaker.

7. The loudspeaker of claim 1 where at least the second surface is removable from the loudspeaker.

8. The loudspeaker of claim 1 further including at least one slot is adapted to be positioned to a side of the second sound source.

* * * * *